US011693365B2

(12) United States Patent
Funakawa et al.

(10) Patent No.: US 11,693,365 B2
(45) Date of Patent: Jul. 4, 2023

(54) WATCH COMPONENT, MOVEMENT, WATCH AND METHOD FOR MANUFACTURING WATCH COMPONENT

(71) Applicant: Seiko Epson Corporation, Tokyo (JP)

(72) Inventors: Takeo Funakawa, Chino (JP); Munehiro Shibuya, Minamiminowa (JP)

(73) Assignee: SEIKO EPSON CORPORATION

( * ) Notice: Subject to any disclaimer, the term of this patent is extended or adjusted under 35 U.S.C. 154(b) by 830 days.

(21) Appl. No.: 16/528,965

(22) Filed: Aug. 1, 2019

(65) Prior Publication Data

US 2020/0041959 A1 Feb. 6, 2020

(30) Foreign Application Priority Data

Aug. 2, 2018 (JP) ..... 2018-146090

(51) Int. Cl.
*G04B 15/14* (2006.01)
*G04D 3/00* (2006.01)

(52) U.S. Cl.
CPC ..... *G04B 15/14* (2013.01); *G04D 3/0069* (2013.01)

(58) Field of Classification Search
CPC ..... G04B 15/14; G04B 13/022; G04D 3/0069
USPC ..... 382/127
See application file for complete search history.

(56) References Cited

U.S. PATENT DOCUMENTS 2,880,570 A * 4/1959 Favret ..... G04B 18/006 368/170
3,248,783 A * 5/1966 Tuetey ..... G04B 15/14 968/102
8,501,584 B2 * 8/2013 Marmy ..... G04D 3/0069 438/455
2010/0054092 A1 3/2010 Marmy et al.
2012/0026845 A1 * 2/2012 Richard ..... G04B 15/14 368/127
2013/0176829 A1 * 7/2013 Cusin ..... G04B 13/025 368/127
2014/0160902 A1 * 6/2014 Cusin ..... G04B 1/10 368/140
2014/0241134 A1 * 8/2014 Niwa ..... G04B 17/222 368/171
2016/0062317 A1 * 3/2016 Nagano ..... H01L 31/0465 368/205

FOREIGN PATENT DOCUMENTS

EP 2579104 A2 * 4/2013 ..... G04B 13/02
JP 2010-509076 A 3/2010
JP 2017064995 A * 4/2017

* cited by examiner

*Primary Examiner* — Edwin A. Leon
*Assistant Examiner* — Kevin Andrew Johnston
(74) *Attorney, Agent, or Firm* — Harness, Dickey & Pierce, P.L.C.

(57) ABSTRACT

Provided is a watch component made of silicon and including a front surface, a back surface, and a side surface intersecting with the front surface and the back surface, the watch component including a first recessed portion formed at the front surface side, a second recessed portion formed at the back surface side, and a communicating groove causing one of the first recessed portion and the second recessed portion to communicate with the side surface.

6 Claims, 10 Drawing Sheets

WATCH COMPONENT, MOVEMENT, WATCH AND METHOD FOR MANUFACTURING WATCH COMPONENT

The present application is based on, and claims priority from, JP Application Serial Number 2018-146090, filed on Aug. 2, 2018, the disclosure of which is hereby incorporated by reference herein in its entirety.

BACKGROUND

1. Technical Field

The present disclosure relates to a watch component, a movement, a watch, and a method for manufacturing a watch component.

2. Related Art

Mechanical watches include a number of watch components mounted therein, with these watch components being typified by gears or the like. Traditionally, watch components have been formed by machining a metal material. In recent years, however, a base material containing silicon is used as a material for watch components. In particular, it has been known that a watch component having a complex structure, in which the front and back have different shapes, is manufactured from a base material containing silicon (see, for example, JP-T-2010-509076).

In JP-T-2010-509076, a first silicon wafer and a second silicon wafer are each subjected to etching, and a first element that forms a first surface side of the silicon component and a second element that forms a second surface side are separately manufactured. Then, by adhering the first element and the second element together, a silicon component having the front and back of different shapes is manufactured.

However, the silicon component described in JP-T-2010-509076 needs to be subjected to a heating oxidation treatment for two to four hours in a high temperature furnace at the time of adhering together the first element and the second element that have been manufactured separately. In other words, in JP-T-2010-509076, in order to manufacture the silicon component, it is necessary to implement a heating oxidation treatment, which requires a long time for processing, in addition to implementing the etching process. This leads to a problem of a decrease in manufacturing efficiency.

SUMMARY

A watch component according to the present disclosure provides a watch component made of silicon and including a front surface, a back surface, and a side surface intersecting with the front surface and the back surface, the watch component including a first recessed portion formed at the front surface side, a second recessed portion formed at the back surface side, and a communicating groove causing one of the first recessed portion and the second recessed portion to communicate with the side surface.

In the watch component according to the present disclosure, a through hole extending from the front surface side to the back surface side may be formed at a position where the first recessed portion and the second recessed portion overlap in plan view.

In the watch component according to the present disclosure, the first recessed portion may have a shape different from that of the second recessed portion.

The watch component according to the present disclosure may be a pallet fork.

A movement according to the present disclosure includes the watch component described above.

A watch according to the present disclosure includes the movement described above.

A method for manufacturing a watch component according to the present disclosure includes a first resist pattern forming step for forming a first surface portion of a silicon substrate, a first etching step for performing etching at the first surface portion side formed with the first resist pattern, a dry film affixing step for affixing a dry film at the first surface portion side, a second resist pattern forming step for forming a second resist pattern surface portion of the silicon substrate on an opposite side from the first surface portion, and a second etching step performing etching at the second surface portion side formed with the second resist pattern.

DESCRIPTION OF EXEMPLARY EMBODIMENTS

Below, exemplary embodiments according to the present disclosure will be described with reference to the drawings.

Movement and Watch

Figure 1:
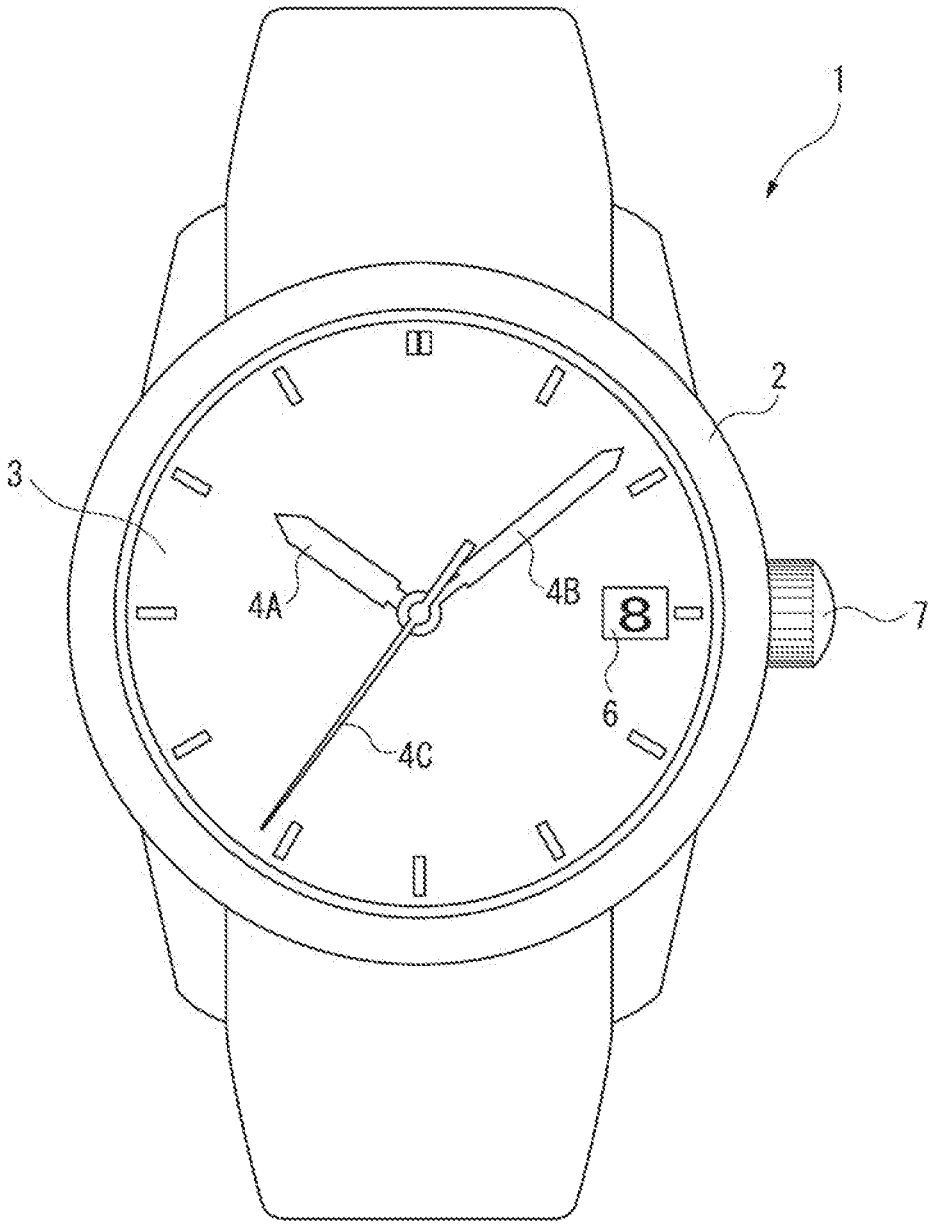
FIG. 1 is a front view illustrating a watch according to one exemplary embodiment of the present disclosure.
Figure 2:
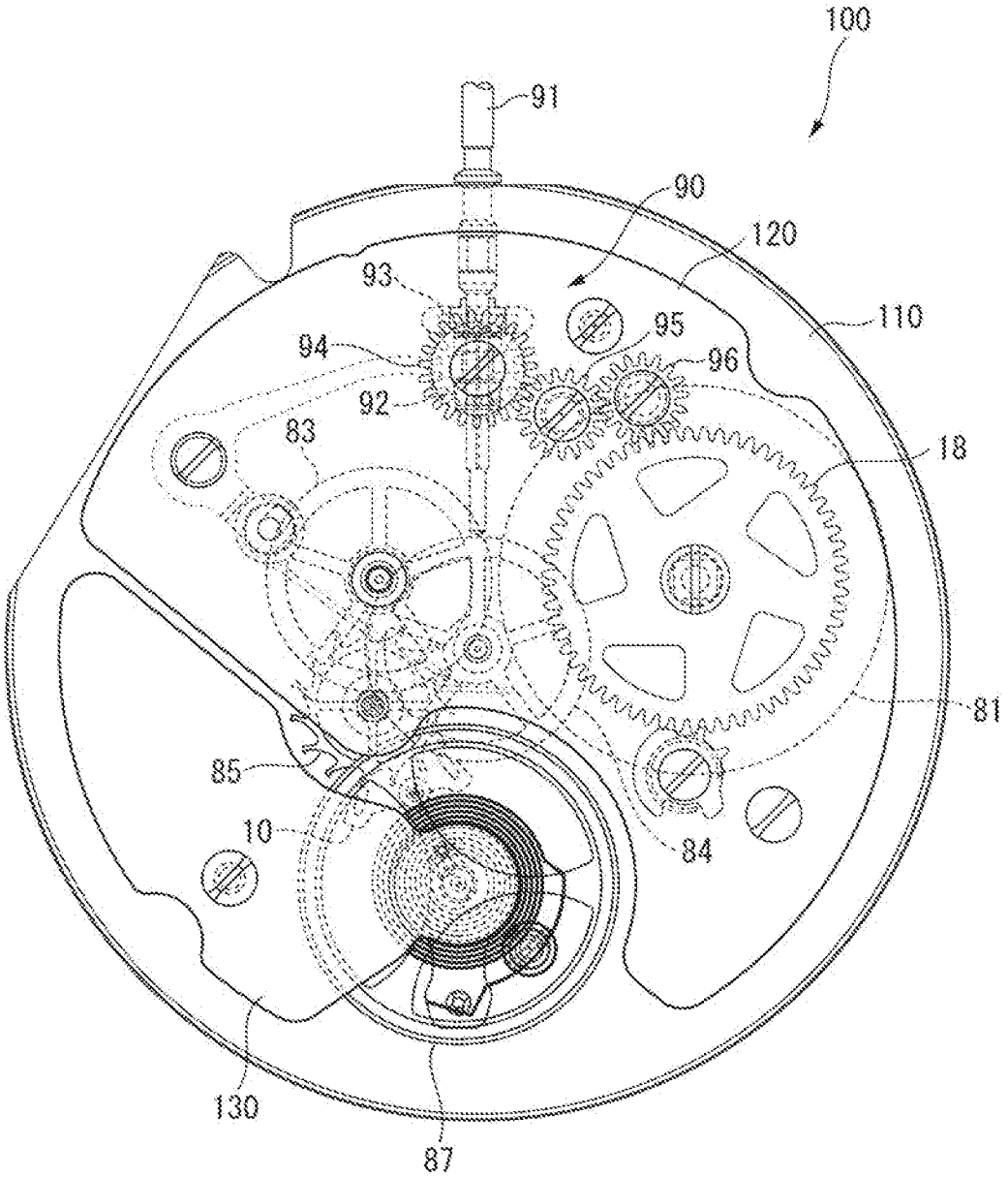
FIG. 2 is a diagram illustrating a movement according to the exemplary embodiment.

FIG. 1 is a front view illustrating a watch 1 according to the present exemplary embodiment. FIG. 2 is a diagram illustrating a movement 100 when viewed from the case back side.

The watch 1 is a wrist watch worn on the wrist of the user, and includes an exterior case 2, a dial 3 provided in the exterior case 2, an hour hand 4A, a minute hand 4B, a second hand 4C, a date indicator 6, and a crown 7 provided on a side surface of the exterior case 2.

The watch 1 includes the movement 100 accommodated within the exterior case 2 as illustrated in FIG. 2. The movement 100 includes a main plate 110, a barrel and train wheel bridge 120, and a balance cock 130. A movement barrel complete 81 housing a mainspring (not illustrated), a center wheel and pinion (not illustrated), a third wheel and pinion 83, a fourth wheel and pinion 84, and an escape wheel 85 are disposed between the main plate 110 and the barrel and train wheel bridge 120. Furthermore, a pallet fork 10, a balance 87, and the like are disposed between the main plate 110 and the balance cock 130. The movement 100 drives the hour hand 4A, the minute hand 4B, and the second hand 4C, which are pointers.

In addition, the movement 100 includes a winding stem 91, a clutch wheel 92, a winding pinion 93, a crown wheel 94, a first intermediate wheel 95, and a second intermediate wheel 96, which serve as a winding mechanism 90 that winds the mainspring. With this configuration, rotation of the rotary operation of the crown 7 is transmitted to a ratchet wheel (not illustrated) to rotate a barrel arbor (not illustrated), and the mainspring can be wound up. Since these are identical to typical mechanical movements, descriptions thereof will be omitted.

Pallet Fork

The configuration of the pallet fork 10 will be described with reference to FIGS. 3 to 6.

Figure 3:
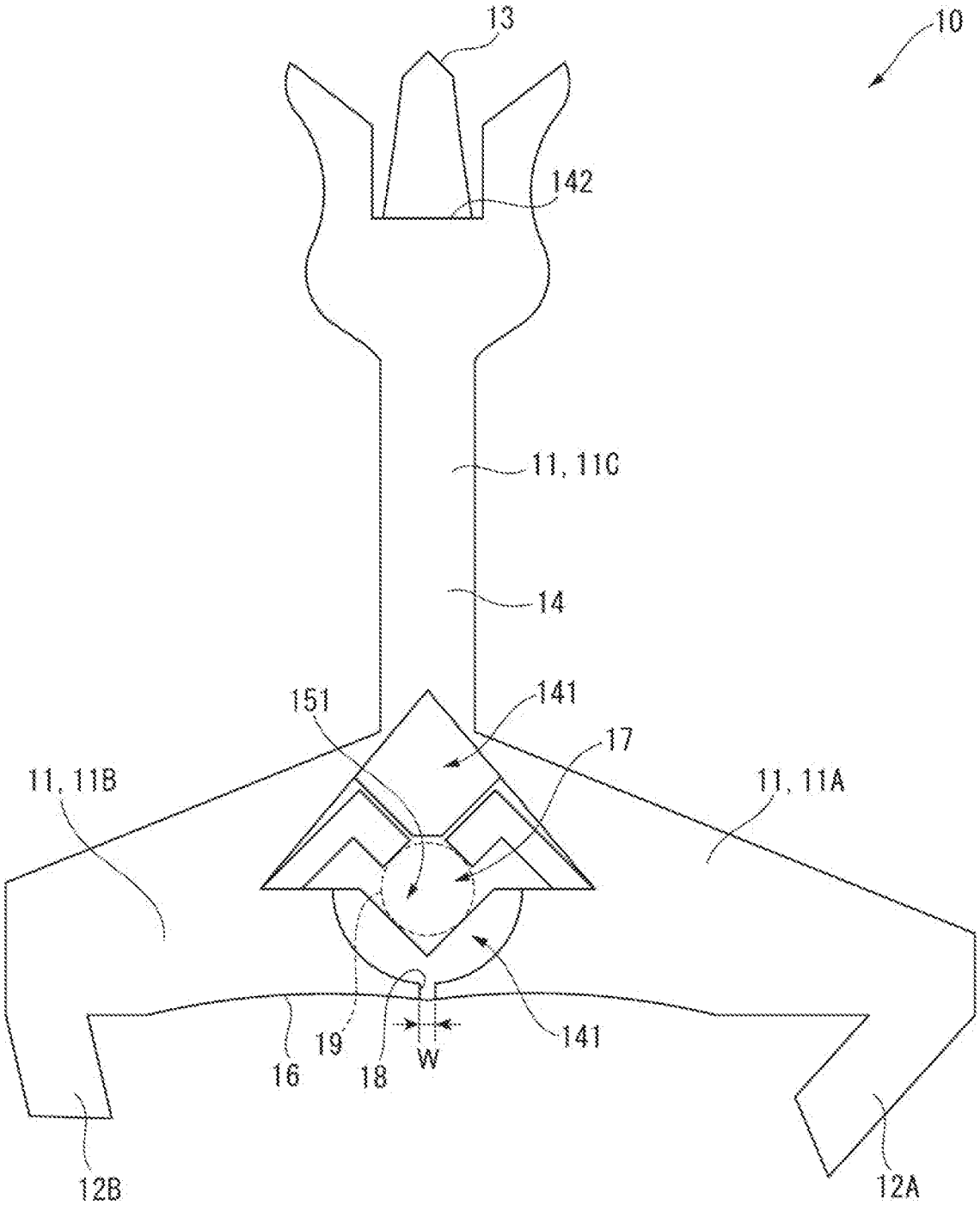
FIG. 3 is a front view illustrating a pallet fork according to the exemplary embodiment.
Figure 4:
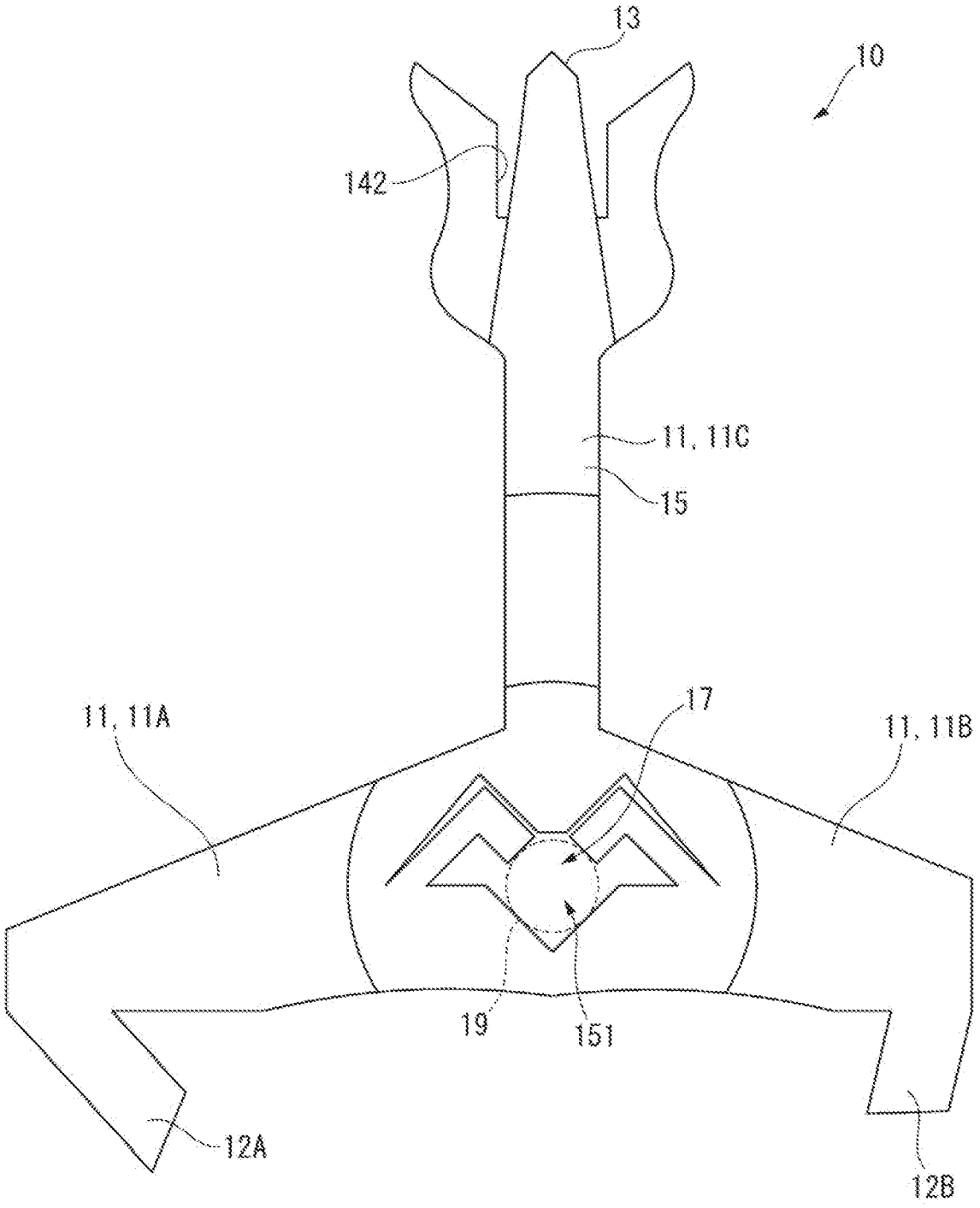
FIG. 4 is a rear view illustrating the pallet fork according to the exemplary embodiment.
Figure 5:
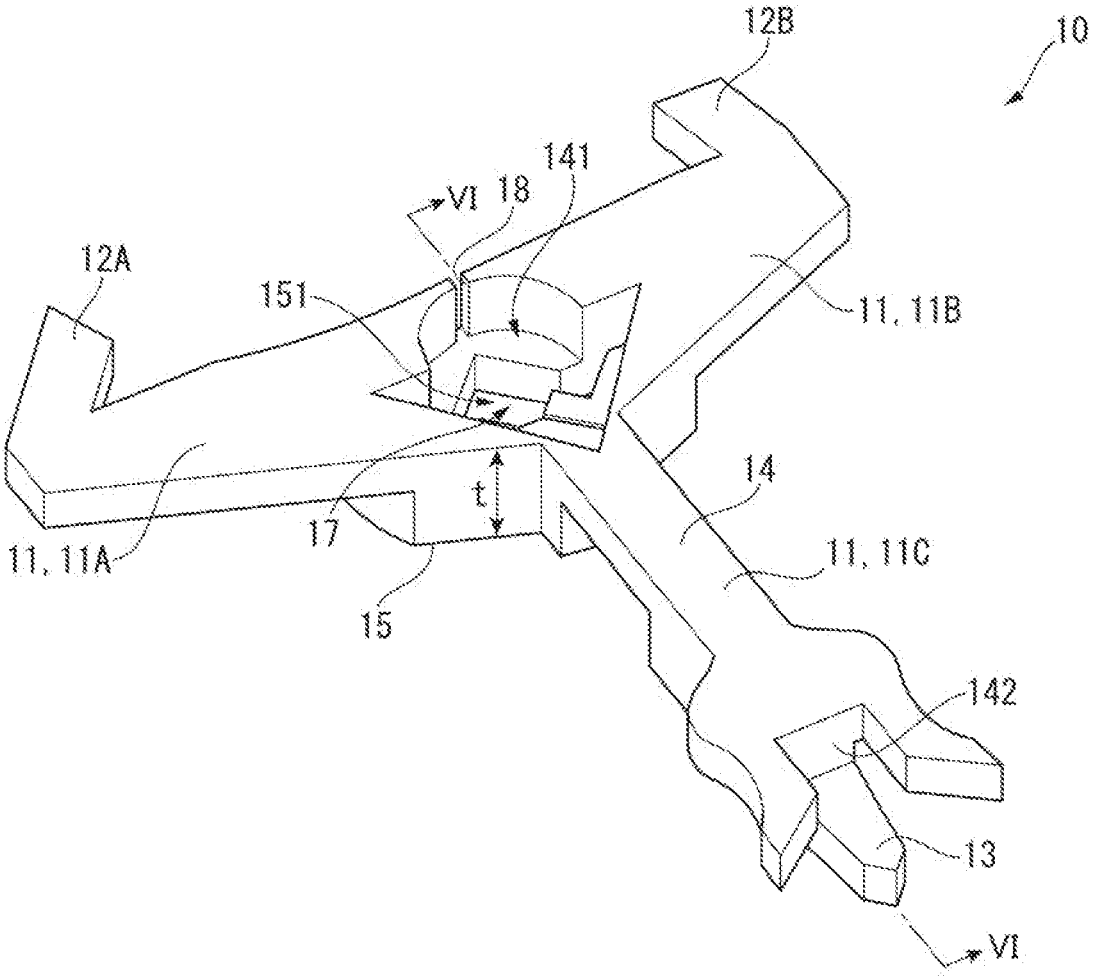
FIG. 5 is a perspective view illustrating the pallet fork according to the exemplary embodiment.
Figure 6:
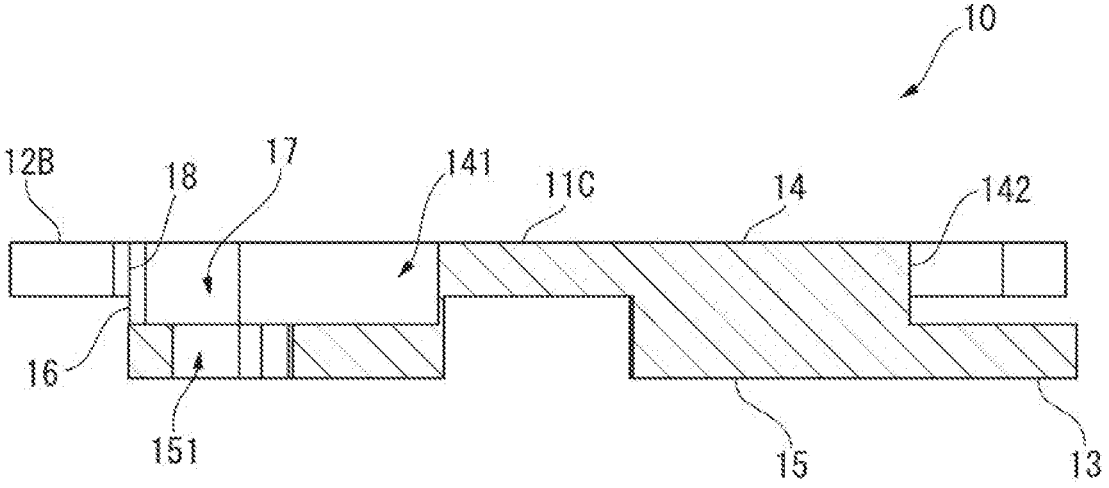
FIG. 6 is a cross-sectional view illustrating the pallet fork according to the exemplary embodiment.

FIG. 3 is a front view schematically illustrating the pallet fork 10. FIG. 4 is a rear view schematically illustrating the pallet fork 10. FIG. 5 is a perspective view schematically illustrating the pallet fork 10. FIG. 6 is a cross-sectional view taken along the line VI-VI in FIG. 5.

As illustrated in FIGS. 3 to 6, the pallet fork 10 is a watch component made of single crystal silicon, and includes a first surface 14 that is a front surface, a second surface 15 that is a back surface, and a side surface 16 that intersects with the first surface 14 and the second surface 15. In the present exemplary embodiment, the thickness t of the pallet fork 10 is approximately 430 μm.

The pallet fork 10 includes three pallet fork beams 11: pallet fork arms 11A and 11B and a pallet fork shaft 11C.

Pallet stones 12A and 12B are formed integrally on the tip ends of two pallet fork arms 11A and 11B of the three pallet fork beams 11. In addition, a guard pin 13 is integrally formed on the tip end of the pallet fork shaft 11C, which is the remaining one.

In the pallet fork 10, a first recessed portion 141 is formed on the first surface 14 side, and a second recessed portion 151 is formed on the second surface 15 side. Furthermore, a step 142 is formed on the tip end of the pallet fork shaft 11C on the first surface 14 side.

The first recessed portion 141 is shaped such that a semicircle is joined to the bottom face of the triangle in plan view, and is formed at a location where the three pallet fork beams 11 meet.

The second recessed portion 151 is shaped such that a trapezoid is coupled to each of two sides of a pentagon in plan view. In this manner, in the present exemplary embodiment, the first recessed portion 141 has a shape differing from the second recessed portion 151.

In addition, the second recessed portion 151 is formed at the bottom surface portion of the first recessed portion 141 in plan view. In other words, in plan view, a through hole 17 that extends from the first surface 14 side to the second surface 15 side of the pallet fork 10 is formed at a position where the first recessed portion 141 and the second recessed portion 151 overlap. A pallet fork arbor 19, which is an axis arbor, is inserted through the through hole 17.

When the pallet fork 10 configured in this manner rotates about the pallet fork arbor 19, the pallet stone 12A or the pallet stone 12B comes into contact with the tip end of the tooth part of the escape wheel 85 as illustrated in FIG. 2. Furthermore, at this time, the pallet fork shaft 11C is brought into contact with two banking pins (not illustrated) provided in the main plate 110. With this configuration, the pallet fork 10 is configured not to rotate in the same direction beyond each of the pins. As a result, the rotation of the escape wheel 85 is also temporarily stopped.

In addition, the first recessed portion 141 includes a communicating groove 18 that communicates the first recess portion with the side surface 16. The communicating groove 18 is used as a passage configured to evacuate air in the first recess 141 in the manufacturing process for the pallet fork 10 described below. Thus, the communicating groove 18 has a dimension suitable to evacuate air. For example, the width W of the communicating groove 18 is approximately 50 μm. However, the width W of the communicating groove 18 is not limited to this, and it is only necessary that the dimension of the communicating groove 18 is set to be able to discharge air in a short period of time in the manufacturing process for the pallet fork 10 described below. For example, it is only necessary that the width W may be equal to or more than 3 μm.

Process for Manufacturing Pallet Fork

A method for manufacturing the pallet fork as described above will be described with reference to the drawings.

FIGS. 7A to 7G are cross-sectional views illustrating the process for manufacturing a pallet fork.

Figure 7:
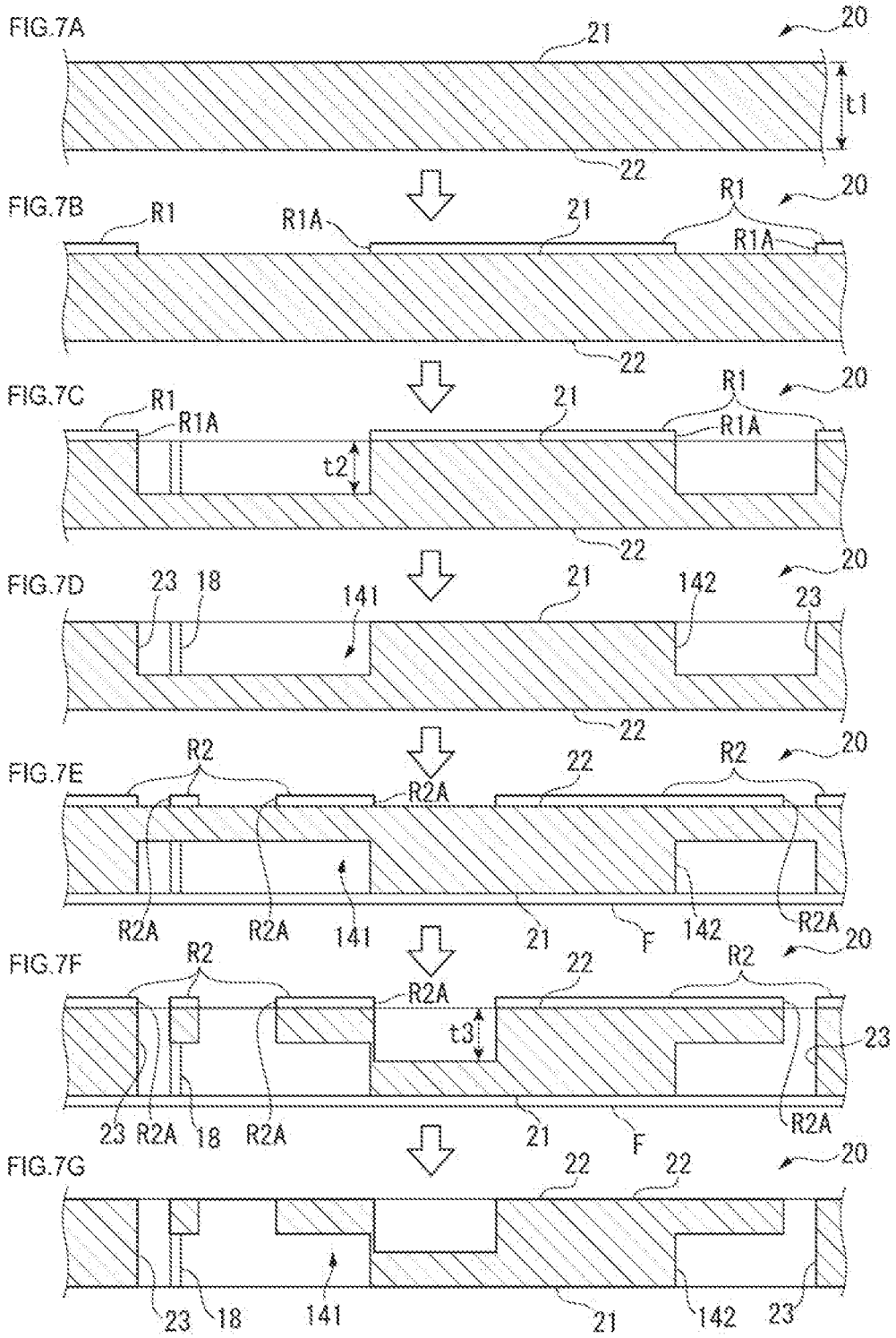
FIG. 7 is a schematic view illustrating a process for manufacturing the pallet fork according to the exemplary embodiment.

In the present exemplary embodiment, the pallet fork 10 is manufactured by using a silicon substrate 20 having a thickness t1 as illustrated in FIG. 7A as a base material, and performing etching to both sides, which are a first surface portion 21 side of the silicon substrate 20 and a second surface portion 22 side that is a surface located on a side opposite to the first surface portion 21. In this exemplary embodiment, for example, the pallet fork 10 is manufactured using a silicon substrate 20 having a thickness t1 of approximately 430 μm as a base material. Note that the thickness t1 of the silicon substrate 20 is not limited to this, and can be appropriately selected according to the specifications of the manufactured watch component.

More specifically, a first resist pattern R1 is first formed on the first surface portion 21 of the silicon substrate 20 illustrated in FIG. 7A using, for example, a photolithography method (first-resist-pattern forming step). FIG. 7B is a diagram illustrating a state in which the first resist pattern R1 has been formed on the first surface portion 21 of the silicon substrate 20. The first resist pattern R1 includes an opening portion R1A. Note that, in the first etching step described below, etching is performed to a location corresponding to the opening portion R1A of the first surface portion 21.

Next, as illustrated in FIG. 7C, etching is performed to the silicon substrate 20 using the first resist pattern R1 as a mask. An example of the etching includes deep reactive ion etching (DRIE) using inductively coupled plasma (ICP).

Figure 8:
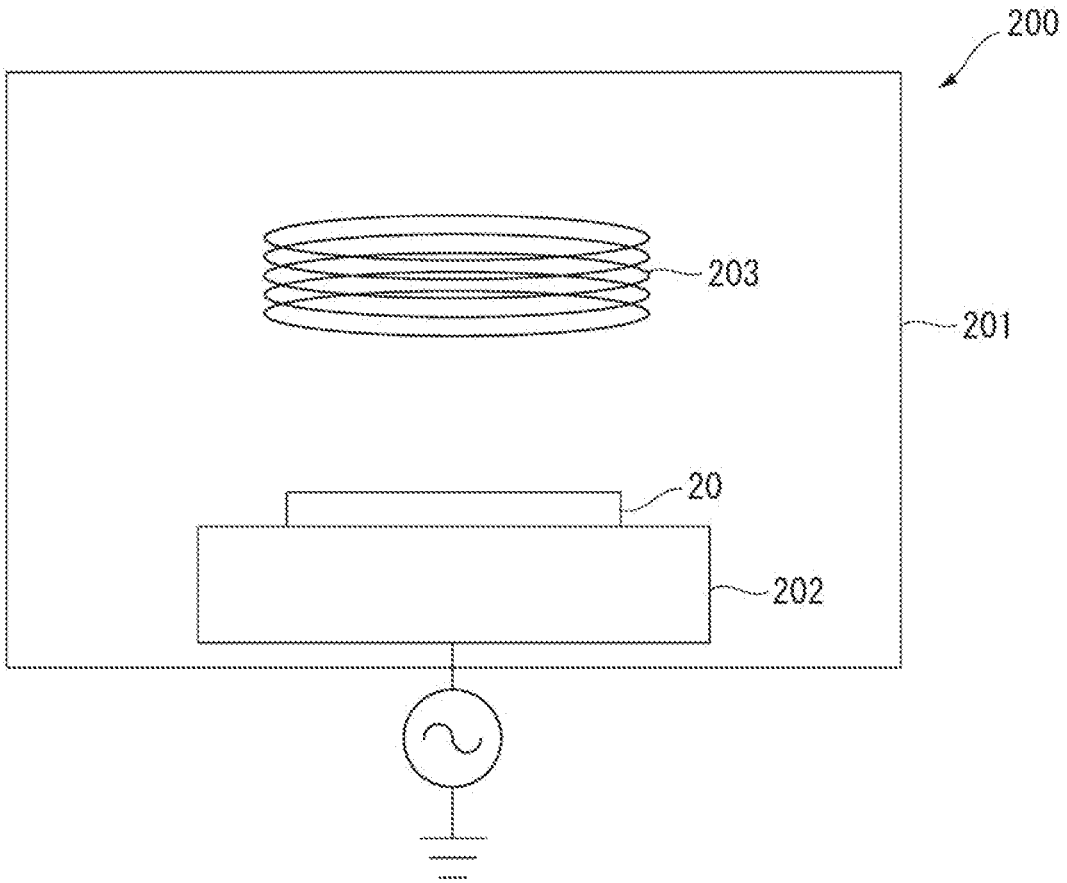
FIG. 8 is a schematic view illustrating an etching device used to manufacture the pallet fork according to the exemplary embodiment.

FIG. 8 is a schematic view illustrating an etching device 200.

The etching device 200 illustrated in FIG. 8 includes a vacuum chamber 201, a stage 202, and a coil 203.

The vacuum chamber 201 is a reaction chamber in which etching is performed, and accommodates the stage 202 and the coil 203 therein.

The silicon substrate 20 illustrated in FIG. 7B is placed on the stage 202 of the etching device 200 described above. At this time, the placement is performed such that the second surface portion 22 side of the silicon substrate 20 faces the upper surface of the stage 202. Then, the pressure in the vacuum chamber 201 is reduced to a predetermined vacuum pressure of, for example, approximately 1 to 30 Pa.

Subsequently, for example, an etching gas such as $SF_6$ is introduced into the vacuum chamber 201, and by flowing a high-frequency high current through the coil 203, plasma of etching gas is generated. After this, by biasing the stage 202, particles of the plasma of the etching gas are drawn from the opening portion R1A of the first resist pattern R1 to the first surface portion 21 of the silicon substrate 20. Through these steps, the silicon substrate 20 is etched substantially perpendicularly in the thickness direction along the first resist pattern R1 from the first surface portion 21 side, and a recessed portion is formed.

Next, for example, a deposition gas such as $C_4F_8$ is introduced into the vacuum chamber 201, and by flowing a high-frequency high current through the coil 203, plasma of the deposition gas is generated. Then, by biasing the stage 202, particles of the plasma of the deposition gas are drawn from the opening portion R1A of the first resist pattern R1 to the first surface portion 21 of the silicon substrate 20. As a result, a protective film is formed on the side wall of the recessed portion formed through etching. In other words, deposition is applied to the side wall of the recessed portion.

Then, by performing a cycle etching process referred as a so-called Bosch process in which etching and deposition as described above are repeatedly performed, a recessed portion having a depth t2 is formed in the first surface portion 21 of the silicon substrate 20 (first etching step). In the present exemplary embodiment, the recessed portion having the depth t2 of, for example, approximately 260 μm is formed. Note that the depth of the recessed portion formed in the first etching step is not limited to this, and may be changed as appropriate depending on the shape of the manufactured watch component.

Furthermore, in this case, the second surface portion 22 side of the silicon substrate 20, namely, the surface side of the silicon substrate 20 placed on the stage 202 is cooled using a cooling gas such as helium gas. Through this step, in the first etching step, the silicon substrate 20 is maintained at a temperature of approximately 10° C. This suppresses the increase in temperature of the silicon substrate 20, and hence, it is possible to prevent excessive reaction between the plasma of the etching gas and the silicon substrate 20 due to the increase in temperature. Thus, it is possible to prevent the perpendicularity of the etching from being impaired, and the machining accuracy of etching on the first surface portion 21 side can be enhanced.

Next, the silicon substrate 20 is removed from the inside of the vacuum chamber 201, and the first resist pattern R1 is removed to bring the silicon substrate 20 in the state illustrated in FIG. 7D. The first resist pattern R1 can be removed through wet etching using fuming nitric acid, organic solvent, or the like, or through oxygen plasma asking or the like.

Figure 9:
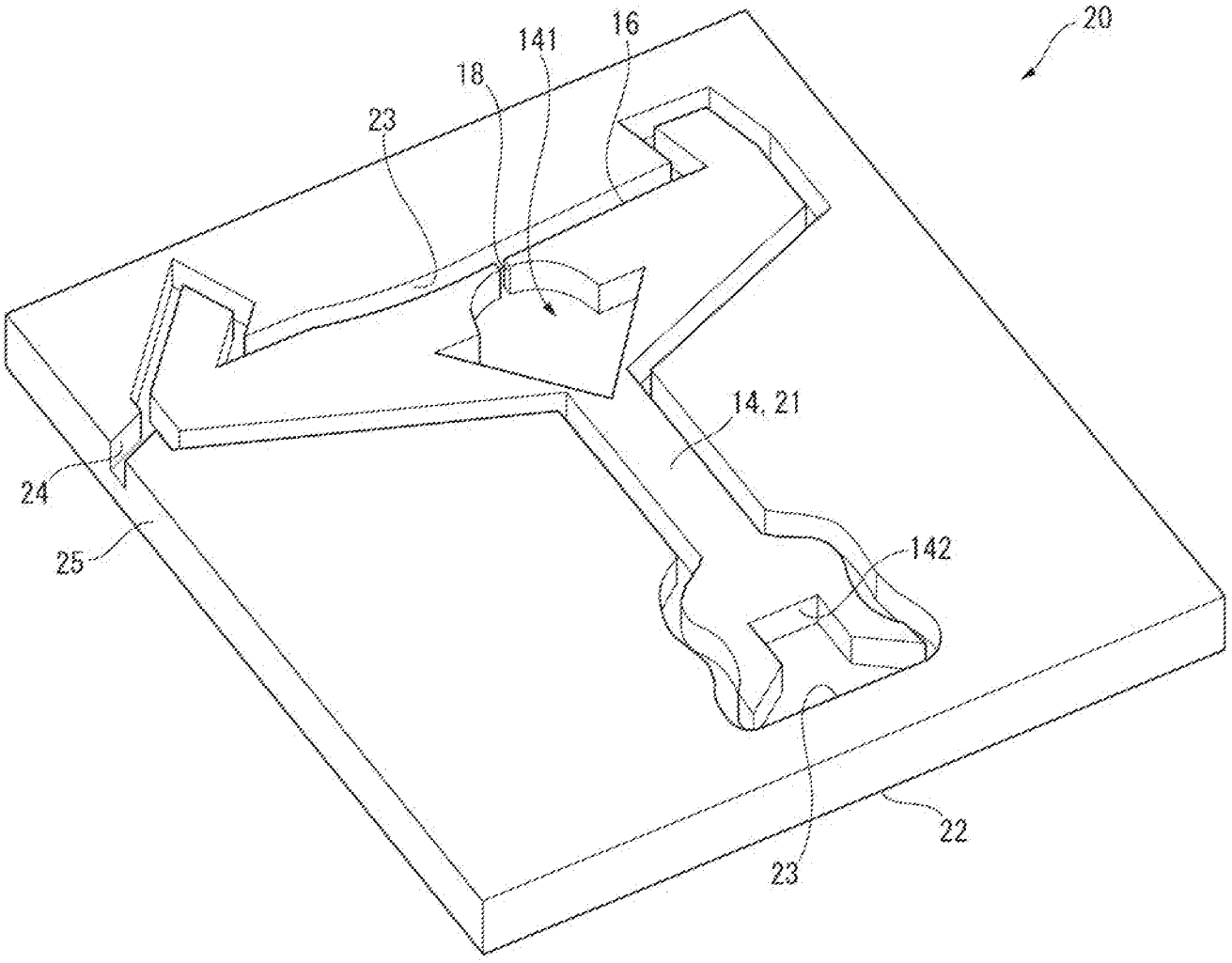
FIG. 9 is a schematic view illustrating a state in the middle of manufacture of the pallet fork according to the exemplary embodiment.

FIG. 9 is a perspective view illustrating the silicon substrate 20 in the state in FIG. 7D.

As illustrated in FIG. 9, the silicon substrate 20 is in a state in which the first surface 14 side of the pallet fork 10 is formed at this stage. In other words, the first surface portion 21 of the silicon substrate 20 constitutes the first surface 14 of the pallet fork 10. As described above, the first recessed portion 141 and the communicating groove 18 that communicates the first recessed portion 141 with the side surface 16 of the pallet fork 10 are formed on the first surface 14 side of the pallet fork 10.

Furthermore, an outer circumferential recessed portion 23 configured to cut the side surface 16 of the pallet fork 10 is formed, and the outer circumferential recessed portion 23 communicates with the side surface portion 25 of the silicon substrate 20 through a groove portion 24.

Note that the step 142 is formed continuously with the outer circumferential recessed portion 23.

Next, as illustrated in FIG. 7E, the dry film F is affixed to the first surface portion 21 of the silicon substrate 20 (dry-film affixing step). In the present exemplary embodiment, a substance in which a photoresist is uniformly applied to a supporting body such as a polyester film is used as the dry film F. With this configuration, it is possible to prevent the dry film F from being damaged due to an etching gas in plasma state in a second etching step that will be described later.

A second resist pattern R2 is formed on the second surface portion 22 of the silicon substrate 20 using, for example, a photolithography method (second-resist-pattern forming step). The second resist pattern R2 includes an opening portion R2A. In the second etching step described below, etching is performed to a position corresponding to the opening portion R2A of the second surface portion 22. Note that FIG. 7E illustrates a state in which the upper and lower portions of the silicon substrate 20 are inverted and the second surface portion 22 side is set to the upper side.

Next, the silicon substrate 20 in the state illustrated in FIG. 7E is again placed on the stage 202 in the vacuum chamber 201. At this time, in contrast to the placement described above, the first surface portion 21 side is placed to face the upper surface of the stage 202. Then, in a manner similar to that described above, the pressure in the vacuum chamber 201 is reduced to be a predetermined vacuum pressure. At this time, the air in the first recessed portion 141 is evacuated from the side surface portion 25 of the silicon substrate 20 through the communicating groove 18, the outer circumferential recessed portion 23, and the groove portion 24 illustrated in FIG. 9.

Subsequently, etching is performed to the silicon substrate 20 in the state illustrated in FIG. 7E through a Bosch process (second etching step). Through the step, as illustrated in FIG. 7E, the silicon substrate 20 is etched substantially perpendicularly in the thickness direction from the second surface portion 22 side along the second resist pattern R2, and a recessed portion having a depth t3 is formed (second etching step). In the present exemplary embodiment, a recessed portion having the depth t3 of, for example, approximately 260 μm is formed. Note that, as in the first etching step, the depth of the recessed portion formed in the second etching step is not limited to this, and it may be possible to change it as appropriate depending on the shape of the manufactured watch component.

In addition, a through hole that passes through the silicon substrate 20 from the first surface portion 21 side to the second surface portion 22 side is formed at a portion where the etched portion of the first surface portion 21 side and the etched portion of the second surface portion 22 overlap with each other. In other words, the through hole 17 illustrated in FIG. 3 is formed.

At this time, similar to the first etching step, the first surface portion 21 side is cooled using the cooling gas. The dry film F, however, is affixed to the first surface portion 21 side, and hence, the cooling gas does not escape from the first surface portion 21 side to the second surface portion 22 side through the through hole 17. Thus, even in the second etching step, the silicon substrate 20 can be efficiently cooled, and hence, it is possible to suppress excessive reaction between the plasma of the etching gas and the silicon substrate 20 due to the increase in temperature. Thus, it is possible to prevent the perpendicularity of etching from being impaired, and the machining accuracy of etching on the second surface portion 22 side can be increased.

Then, the silicon substrate 20 is removed from the inside of the vacuum chamber, and the second resist pattern R2 and the dry film F are removed to make the silicon substrate 20 in the state illustrated in FIG. 7G.

Finally, the portion that constitutes the pallet fork 10 is removed from the silicon substrate 20 to manufacture the pallet fork 10.

Effect of the Present Exemplary Embodiment

According to the present exemplary embodiment described above, the following effects can be obtained.

The pallet fork 10 is a watch component made of single crystal silicon and including a first surface 14 that is a front surface, a second surface 15 that is a back surface, and a side surface 16 that intersects with the first surface 14 and the second surface 15. The pallet fork 10 includes a first recessed portion 141 formed on the first surface 14 side, a second recessed portion 151 formed on the second surface 15 side, and a communicating groove 18 that communicates the first recessed portion 141 with the side surface 16.

In the present exemplary embodiment, the pallet fork 10 as described above is manufactured by performing etching to the first surface portion 21 side of the silicon substrate 20 serving as a base material, and then performing etching to the second surface portion 22 side. At this time, the dry film F is affixed to the first surface portion 21 side after the first surface portion 21 side is performed machining and before the second surface portion 22 side is performed machining. Through these steps, when the second surface portion 22 side is performed machining, the first surface portion 21 side can be cooled with cooling gas, and it is possible to prevent excessive reaction between the plasma and the silicon substrate 20 due to the increase in the temperature of the silicon substrate 20.

Here, when the communicating groove 18 is not formed in the first recessed portion 141, the first recessed portion 141 becomes a sealed space once the dry film F is affixed to the first surface portion 21. Thus, even when the air pressure in the vacuum chamber is reduced to the vacuum pressure when the second surface portion 22 side is performed machining, the interior of the first recessed portion 141 is maintained at an atmospheric pressure. This causes a difference in air pressure to be generated between the inside and the outside of the first recessed portion 141, which may damage the dry film F.

On the other hand, in the present exemplary embodiment, air in the first recessed portion 141 is evacuated through the communicating groove 18, the outer circumferential recessed portion 23, and the groove portion 24. In other words, as the interior of the first recessed portion 141 is at a vacuum pressure, no air pressure difference is generated between the inside and the outside of the first recessed portion 141. Thus, the dry film F is not damaged due to the difference in air pressure.

In this manner, in the present exemplary embodiment, by providing the communicating groove 18 that communicates the first recessed portion 141 with the side surface 16, it is possible to perform etching to both sides of the silicon substrate 20 while cooling with the cooling gas. In other words, it is possible to perform etching to both sides of a single silicon substrate 20 with high machining accuracy. Thus, in the manufacturing process for the pallet fork 10, it is not necessary to manufacture the pallet fork 10 by manufacturing the first surface 14 side and the second surface 15 side from separate silicon substrates and adhering them together. This makes it possible to increase the manufacturing efficiency of the pallet fork 10.

In addition, in the present exemplary embodiment, it is possible to manufacture the pallet fork 10 from a single silicon substrate 20. This eliminates an adhering portion or the like formed where manufacturing is performed such that the first surface 14 side and the second surface 15 side are manufactured separately, and are adhered to each other. Thus, there is no risk of the adhering portion being peeled off, and hence, it is possible to enhance the strength of components.

In the present embodiment, the through hole 17 that extends from the first surface 14 side to the second surface 15 side is formed at a position where the first recessed portion 141 and the second recessed portion 151 overlap with each other in plan view. This allows the pallet fork arbor 19 to be inserted through the through hole 17, thus the pallet fork 10 can be configured to be able to rotate with the pallet fork arbor 19 being the axis arbor. In other words, it is possible to apply the watch component according to the present exemplary embodiment to a rotatable component.

In the present exemplary embodiment, the first recessed portion 141 has a shape differing from the shape of the second recessed portion 151. Thus, as with the pallet fork 10, the watch component according to the present exemplary embodiment can be applied to a component having a complex structure in which the front and back sides have different shapes.

Other Exemplary Embodiments

Note that the present disclosure is not limited to the exemplary embodiment described above, and variations, modifications, and the like within the scope in which the object of the present disclosure can be achieved are included in the present disclosure.

The exemplary embodiment has described, as an example, a case where one pallet fork 10 is manufactured from a silicon substrate 20. However, the present disclosure is not limited to this, and it may be possible to manufacture a plurality of pallet forks from one silicon substrate.

Figure 10:
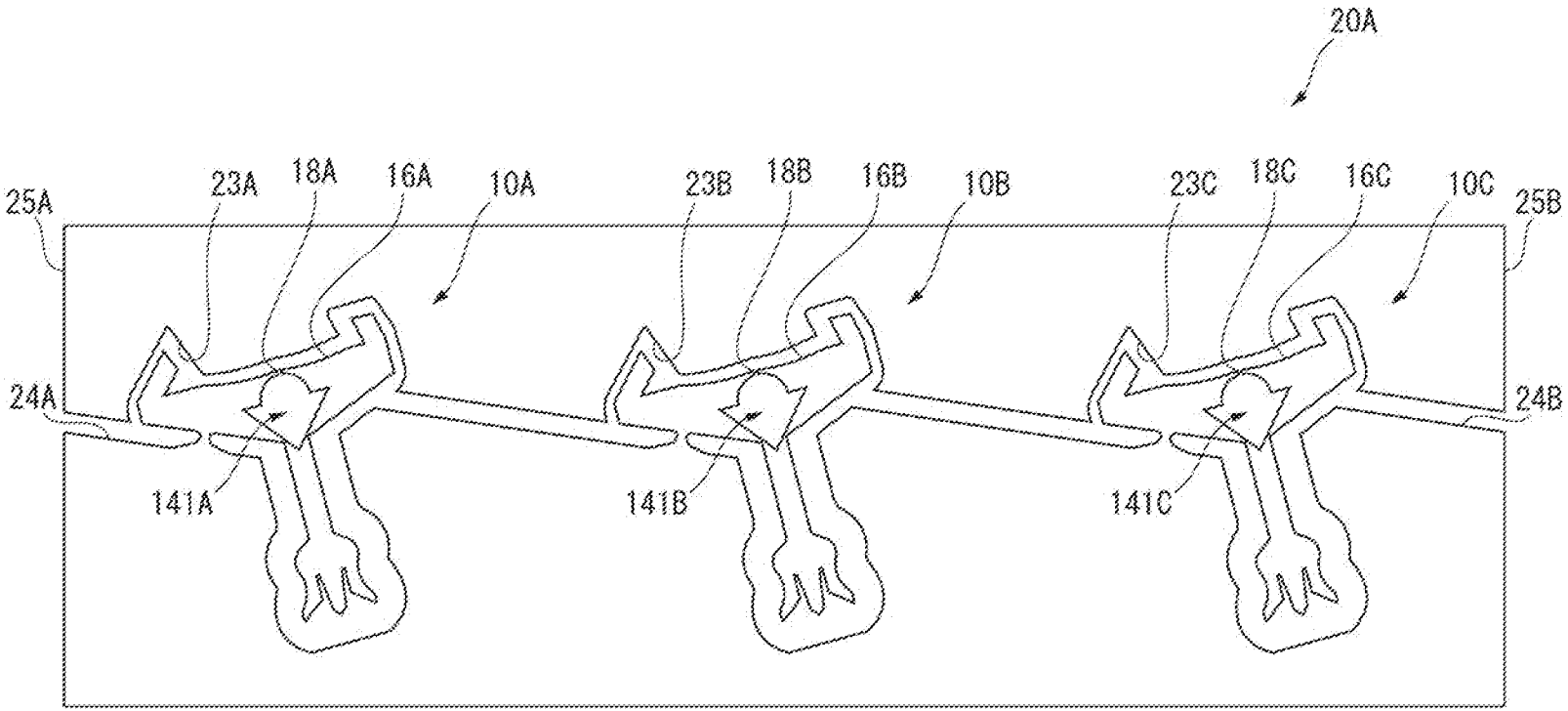
FIG. 10 is a schematic view illustrating the middle of manufacture of a pallet fork according to another exemplary embodiment.

FIG. 10 is a schematic diagram illustrating the manufacturing process in progress in a case where a plurality of pallet forks are manufactured from a silicon substrate 20A. As illustrated in FIG. 10, three pallet forks 10A, 10B, and 10C may be manufactured from the silicon substrate 20A.

In addition, in this case, it may be possible to employ a configuration in which outer circumferential recessed portions 23A, 23B, 23C configured to cut out side surfaces 16A, 16B, 16C of the pallet forks 10A, 10B and 10C are caused to be communicated with each other, and the outer circumferential recessed portions 23A, 23B and 23C are caused to communicate with the side surface portions 25A and 25B of the silicon substrate 20A through groove portions 24A and 24B, as illustrated in FIG. 10. With this configuration, in the manufacturing process described above, the air in the first recessed portion 141A, 141B and 141C can be evacuated from the side surface portion 25A and 25B of the silicon substrate 20A through the communicating groove 18A, 18B and 18C, the outer circumferential recessed portion 23A, 23B and 23C, and the groove portion 24A and 24B. Note that it may be possible to employ a configuration in which the outer circumferential recessed portions 23A, 23B and 23C do not communicate with each other, and each of the outer circumferential grooved portions 23A, 23B and 23C communicates with the side surface 25A and 25B of the silicon substrate 20A.

In the exemplary embodiment described above, the communicating groove 18 that communicates the first recessed portion 141 with the side surface 16 is formed. However, the present disclosure is not limited to this. For example, it may be possible to form a communicating groove 18 that communicates the second recessed portion 151 with the side surface 16. In this case, in the manufacturing process for the pallet fork 10, etching is performed from the second surface 15 side on which the second recessed portion 151 is formed. With this configuration, when etching is performed to the first surface 14 side after etching is performed to the second surface 15 side, the second recessed portion 151 is not a sealed space even when the dry film F is affixed to the second surface 15 side. Thus, it is possible to prevent the dry film F from being damaged due to the difference in air pressure.

In addition, it may be possible to form the communicating groove 18 in both the first recessed portion 141 and the second recessed portion 151. In this case, regardless of whether etching is performed to the first surface 14 side on which the first recessed portion 141 is formed or the second surface 15 side on which the second recessed portion 151 is formed, it is possible to prevent the dry film F from being damaged as described above. Thus, it is possible to increase the degree of freedom in the manufacturing process.

In the exemplary embodiment described above, the through hole 17 that extends from the first surface 14 side to the second face 15 side is formed. However, the present exemplary embodiment is not limited to this configuration. For example, the watch component according to the present exemplary embodiment may be applied to a component in which the through hole 17 is not formed.

In this case, a dry film is affixed with the aim of preventing the cooling gas from leaking out through the through hole configured to cut the outer periphery of the watch component.

In the exemplary embodiment described above, the first recessed portion 141 and the second recessed portion 151 differ in shape. However, the first recessed portion 141 formed on the first surface 14 side and the second recessed portion 151 formed on the second surface 15 side may have the same shape, for example. In other words, the watch component according to the present exemplary embodiment may be applied to a component in which the first surface 14 side and the second surface 15 side have the same shape.

In the exemplary embodiment described above, the pallet fork 10 is given as an example of a watch component. However, the watch component is not limited to this. The watch component may be, for example, a crown wheel or the like. Furthermore, these watch components may be mounted on a movement alone or in combination of two or more types.

What is claimed is:

1. A watch component made of silicon, the watch component comprising:
- a front surface including a first recessed portion;
- a back surface including a second recessed portion; and
- a side surface intersecting with the front surface and the back surface, the side surface communicating with one of the first recessed portion and the second recessed portion via a communicating groove;
- a through hole formed at a position where the first recessed portion and the second recessed portion overlap in plan view and through which a shaft is inserted; and
- two arms formed in the other of the first recessed portion and the second recessed portion, and pressing the shaft,
- wherein the communicating groove has a depth that is the same as that of one of the first recessed portion and the second recessed portion.

2. The watch component according to claim 1, wherein the through extends from the front surface side to the back surface side.

3. The watch component according to claim 1, wherein the first recessed portion has a shape different from that of the second recessed portion.

4. A movement comprising the watch component according to claim 1.

5. A watch comprising the movement according to claim 4.

6. A method for manufacturing the watch component according to claim 1, the method comprising:
- forming a first resist pattern at a first surface portion of a silicon substrate;
- etching the first surface portion formed with the first resist pattern;
- affixing a dry film at the first surface portion;
- forming a second resist pattern at a second surface portion on an opposite side of the silicon substrate from the first surface portion; and
- etching the second surface portion formed with the second resist pattern.

* * * * *